United States Patent [19]

Tengler et al.

[11] Patent Number: 4,626,054

[45] Date of Patent: Dec. 2, 1986

[54] CABLE TERMINATION SYSTEM WITH DIAGONAL SIGNAL TERMINATOR

[75] Inventors: John N. Tengler; James C. Pilny, both of Chico, Calif.

[73] Assignee: Minnesota Mining and Manufacturing Company, St. Paul, Minn.

[21] Appl. No.: 621,663

[22] Filed: Jun. 18, 1984

[51] Int. Cl.[4] ..... H01R 11/00

[52] U.S. Cl. ..... 339/59 M; 339/198 H

[58] Field of Search ..... 339/59 R, 59 M, 60 R, 339/60 M, 61 R, 61 M, 176 M, 198 H, 198 G

[56] References Cited

U.S. PATENT DOCUMENTS

| | | | |
|---|---|---|---|
| 3,842,388 | 10/1974 | Harwood et al. | 339/59 R |
| 4,368,939 | 1/1983 | Foederer | 339/59 M |
| 4,474,417 | 10/1984 | Millhimes et al. | 339/59 M |

*Primary Examiner*—Gil Weidenfeld
*Assistant Examiner*—Paula A. Austin
*Attorney, Agent, or Firm*—Renner, Otto, Boisselle & Lyon

[57] ABSTRACT

In a cable termination system, there is provided a terminator pair for terminating conductors of respective cables. Each terminator comprises a body of insulating material having a pair of contact anchor portions joined by a diagonal web portion at one end of the body and diagonally spaced at the other end of the body to receive the diagonal web portion of the other terminator for mating compact interengagement, and at least one contact anchored in each contact anchor portion for connecting a respective signal conductor of the respective cable to another member. The contact anchor portions are substantially rectangular in transverse profile and occupy respective quadrants of the terminator pair which correspondingly are substantially rectangular for mating receipt in a cavity in a housing or holder. The terminator pairs constitute basic building blocks for the system and are insertable into housings to provide a high density multi-connector pin-out configuration. Each terminator also includes a lock for locking the terminator pair in a housing provided with a resilient locking tab capable of being flexed to provide selective release of the terminators from the housing.

41 Claims, 23 Drawing Figures

CABLE TERMINATION SYSTEM WITH DIAGONAL SIGNAL TERMINATOR

DISCLOSURE

This invention relates generally to electrical connectors and more particularly to an electrical connector system and the terminators, terminations and cable termination assemblies utilized therein to provide desired multi-connector pin-out configurations for cable systems utilizing shielded twisted pair, twin-ax or like cable constructions to maintain discrete wire capability in the cable system.

BACKGROUND

In modern computers and other electronic equipment, cable transmission of typically high speed signals is common. To maintain the integrity of such high speed signals and also to maintain discrete wire capability in such computers or other electronic equipment, a variety of signal cable constructions have been utilized including, for example, coaxial cables wherein a central conductor of the cable transmits the high speed signal while the shielding or external conductor provides appropriate ground or other reference plane isolation or shielding. Shielded twisted pair, twin-ax and other cable constructions also have been utilized.

Various electrical connector systems have been used for terminating such cables, but with varying degrees of acceptability. A common problem associated with prior art connector systems has been the inability to reduce crosstalk at the cable termination interface while still achieving desired multi-connector pin-out configurations as well as discrete wire capability. Another problem has been the size and configuration of terminators and terminations used in some systems which make it impossible to achieve a relatively high density multi-connector pin-out capability. In systems which do achieve relatively high density pin-out, a problem has been the inability to remove individual cable terminations from housings or holders therefor without having to disassemble substantially the connector system. Still another problem in female connector systems has been difficulty in properly locating fork contacts in housings socketed to mate with male or pin contacts of another connector or member.

SUMMARY OF THE INVENTION

The electrical connector system of the present invention avoids one or more of the aforementioned disadvantages while providing desired high density multi-connector pin-out configurations with discrete wire capability in cable systems utilizing shielded twisted pair, twin-ax or like cable constructions. Such system is particularly characterized by the novel manner in which signal conductors of respective cables or conductor sets are terminated at diagonally opposed contact position in a relatively high density or close-packed multi-connector pin-out configuration. The invention also enables removal of individual cable terminators from housings or holders therefor without substantial disassembly of the overall connector system as well as precise locating of the coupling portions of female contacts in housings socketed to mate with male or pin contacts of another connector or member.

According to one aspect of the invention, there is provided a terminator pair for terminating conductors of respective cables or conductor sets. Each terminator comprises a body of insulating material having a pair of contact anchor portions joined by a diagonal web portion at one end of the body and diagonally spaced at the other end of the body to receive the diagonal web portion of the other terminator for mating compact interengagement, and at least one contact anchored in each contact anchor portion for connecting a respective conductor of the respective cable or conductor set to another member. The contact anchor portions may be substantially rectangular in transverse profile and occupy respective quadrants of the terminator pair which correspondingly is substantially rectangular for mating receipt in a cavity in a housing or holder. One or more terminator pairs may be inserted into respective sockets of the housing to provide a high density multi-connector pin-out configuration.

Further in accordance with the invention, each cable or conductor set associated with the terminator pair includes two signal carrying conductors, herein referred to as signal conductors. The signal conductors are electrically connected and thus terminated at respective signal contacts anchored in respective contact anchor portions of the terminator body at diagonally opposed positions in relation to the overall pin-out configuration or matrix. This provides a spacing between the signal contacts which is greater than the on center spacing of the pin-out matrix by the difference between the hypotenuse and sides of a triangle defined at its vertices by three adjacent triangularly disposed pin-out positions in the matrix. In a desired $0.100 \times 0.100$ inch pin-out matrix, for example, the spacing between the signal contacts is 0.1414 inch. This serves to reduce crosstalk between signal carrying elements at the cable termination interface.

Moreover, a portion of the cable including the conductors thereof is held in one contact anchor portion of the respective terminator body with one signal conductor extending through the diagonal web portion for connection to the respective signal contact anchored in the other contact anchor portion. The cable or conductor set also may include a drain wire and/or shield (hereinafter ground conductor) connected to a second or ground contact anchored in such one contact anchor portion at a respective position in the pin-out matrix. Preferably the body is formed of plastic or plastic-type material that is molded directly about and to at least a part of the cable, contacts and junctions between the contacts and conductors in a manner that provides substantially hermetic encapsulation of the junctions, on the one hand, and secure strain relief retention of the cable in the body without applying strain to the junctions.

Also, each terminator pair having pin-out capability for ground conductors of the associated cables forms a modular termination building block having a $2 \times 3$ pin-out configuration for assembly in a termination housing. Such modular building block affords the ability to simply change termination housings to provide a multi-connector pin-out configuration having an odd or even number of rows while utilizing the same terminators changed only in orientation relative to the row axis of the housing. That is, the terminators constitute the basic building block for a cable termination system according to the invention. While achieving the aforenoted and related advantages, each terminator still ensures discrete wire capability in the cable termination system.

According to another aspect of the invention, at least one terminator of each pair thereof includes a lock for locking the terminator pair in the housing. As is preferred, each terminator includes a locking detent adjacent that of the other and both detents are engageable in a common aperture provided in a deflectable portion of the housing in the form of a rearwardly projecting tab capable of being flexed to provide selective release of one or both terminators from the housing independently of any other terminators that also may be locked in the housing.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION

Figures 1, 2, 3, 4, 5:
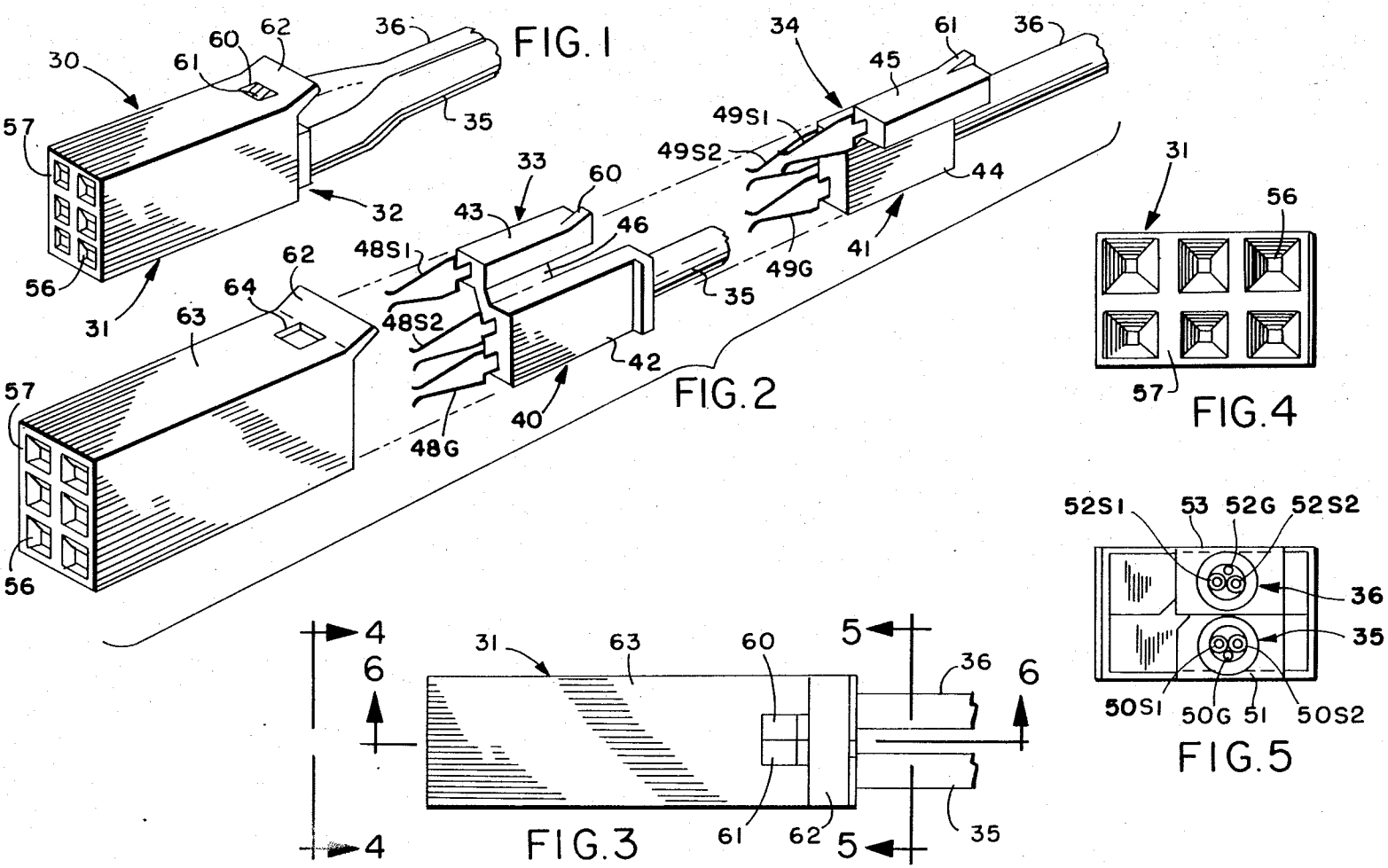
FIG. 1 is an isometric view of an electrical connector system according to the invention.
FIG. 2 is a longitudinally exploded isometric view of the electrical connector system of FIG. 1.
FIG. 3 is a top view of the electrical connector system of FIG. 1.
FIG. 4 is a front view of the electrical connector system looking generally in the direction of the arrows 4—4 of FIG. 3.
FIG. 5 is a back view of the electrical connector system looking generally in the direction of the arrows 5—5 of FIG. 3.

Referring now in detail to the drawings, wherein like reference numerals designate like parts in the several figures, and initially to FIGS. 1 and 2, one embodiment of an electrical connector system according to the present invention is designated generally by reference numeral 30. The system 30, also referred to as a cable termination system, includes a single cell housing or holder 31 into which is inserted and locked a terminator pair indicated generally at 32 to form what is herein generally called a termination. The terminator pair 32 includes terminators 33 and 34 configured for interengagement and insertion into the housing in the manner illustrated in FIG. 2. The terminators 33 and 34 terminate electrical conductors of respective conductor sets or cables 35 and 36. FIGS. 3–6 show various plan and sectional views of the electrical connector system 30 in assembled condition.

Each terminator 33, 34 includes a respective body 40, 41 of insulating material. Each terminator body has a pair of contact anchor portions, those for terminator body 40 being indicated at 42 and 43 in FIG. 2 and those for terminator body 41 being indicated at 44 and 45. The contact anchor portions of each body 40, 41 are joined at one end of the respective body for a respective diagonal web portion 46, 47 and diagonally spaced at the other end of the respective body to receive the diagonal web portion of the other body for mating compact interengagement of the terminators. Each terminator 33, 34 further includes at least one contact 48, 49 anchored in each contact anchor portion of its body 40, 41 for connecting a respective conductor of the respective cable 35, 36 to another member.

Figure 6:
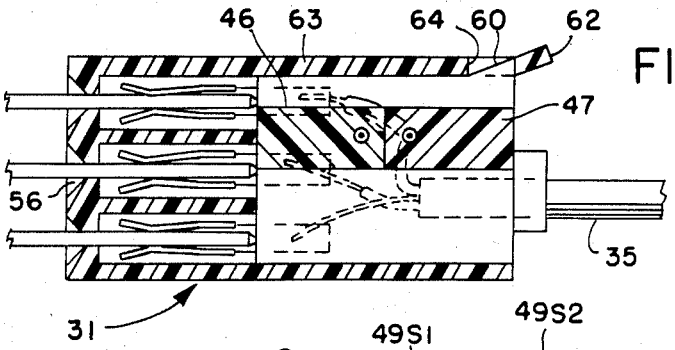
FIG. 6 is a longitudinal section through the electrical connector system taken substantially along the line 6—6 of FIG. 3.

The cables 35 and 36 utilized in the illustrated embodiment are both of the twin-ax type including three electrical conductors. In FIGS. 5 and 6, the conductors of cable 35 are commonly identified by the same reference numeral 50 which is suffixed to distinguish between the conductors in accordance with an exemplary and desired application of the connector system 30. Two of the conductors suffixed "S1" and "S2" are individually insulated and typically are used as signal carrying conductors. Accordingly, conductors 50S1 and 50S2 hereinafter are referred to as signal conductors. The third conductor suffixed "G" (often called a drain wire) is not individually insulated and typically is utilized to provide appropriate ground or reference plane isolation between the signal conductors 50S1 and 50S2. The conductor 50G is hereinafter referred to as a ground conductor although it may be maintained at a reference potential other than ground potential. As shown, the ground conductor is positioned intermediate the signal conductors, and such positional relationship is maintained by an electrically insulating cable sheath 51 encasing the conductors.

Similarly, the cable 36 includes two signal conductors 52S1 and 52S2 and a ground conductor 52G. Likewise, the ground conductor is positioned intermediate the signal conductors and such positional relationship is maintained by an electrically insulating cable sheath 53 encasing the conductors.

In FIG. 2, each terminator 33, 34 can be seen to include three contacts 48, 49. The contacts 48, 49 each are suffixed in like manner to the respective conductors 50, 52 to which they are electrically connected for purposes of connecting such conductors to respective contacts of another member. The signal contact 48S1 is anchored in the contact anchor portion 43 of body 40 whereas the signal and ground contacts 48S2 and 48G are anchored in coplanar relation in the contact anchor portion 42 of such body. Similarly, the contact 49S1 is anchored in the contact anchor portion 45 of body 41 and the contacts 49S2 and 49G in the contact anchor portion 44 of such body.

When the terminators 33 and 34 are received in the housing 31, the contacts 48 and 49 are located at respective positions of a dual row multi-connector pin-out configuration or matrix. Such pin-out configuration corresponds to the arrangement of access holes 56 provided in the front wall 57 of the housing. The access holes serve to guide the contacts of another member, in this case male or pin contacts, into engagement with respective contacts of the terminators.

To provide a desired pin-out configuration, the signal contacts 48S1 and 48S2 of the terminator 33 are at diagonally opposite positions in respective rows. Likewise, the signal contacts 49S1 and 49S2 are at diagonally opposed positions. Also, the signal contacts 48S1 and 48S2 of the terminator 43 are transversely aligned with respective signal contacts 49S1 and 49S2 of the other terminator 34 as are the ground contacts 48G and 49G of such terminators. This is in contrast to related terminator pairs of conventional type wherein contacts associated with each terminator are located at transversely opposed positions of the resultant pin-out configuration. In the illustrated arrangement, the signal contacts of each terminator are spaced further apart the now pin-out spacing of the overall pin-out configuration. In a desired $0.100 \times 0.100$ inch pin-out matrix, for example, the spacing between the signal contacts of each terminator is 0.1414 inch, i.e., 0.100/Sin (45°). This affords greater signal separation at the termination interface of each terminator.

As further seen in several of FIGS. 1–6, the terminators 33 and 34 have locking or anchoring hooks 60 and 61 formed integrally with the contact anchor portions 43 and 45 of the terminator bodies 40 and 41, respectively. When the terminators are inserted into the housing 31, the anchoring hooks operate to deflect outwardly a rearwardly extended flexible tab portion 62 of the top wall 63 of the housing which deflects or snaps back to its original position after the anchoring hooks have moved therepast and into an opening 64 in the top wall 63. The anchoring hooks thusly cooperate with the tab portion 62 and opening 64 to form a detent coupling securely anchoring the terminators in the housing. When the terminators are properly nested, the anchoring hooks are in side-by-side relation whereby only a single tab portion 62, hereinafter locking tab, and opening 64 need be provided to provide desired coupling. As will be appreciated, the anchoring hook 60 of terminator 33 may be eliminated inasmuch as the terminator 33 will be held in the housing by the other terminator 34 when the latter is anchored in the housing in the indicated manner. When desired, the terminators may be easily removed from the housing by flexing outwardly the locking tab 62 sufficiently to clear the anchoring hooks for rearward withdrawal of the terminators from the housing. The anchoring hooks also function as polarizing elements dictating proper insertion orientation of the terminators relative to the housing.

Figure 7:
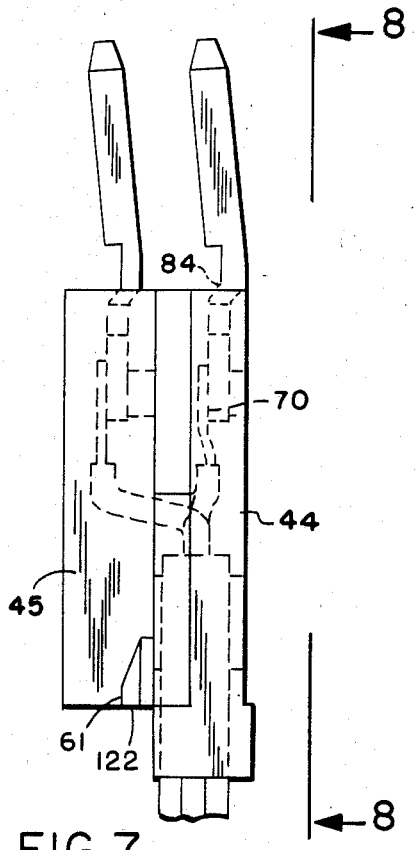
FIG. 7 is a top view of one terminator of a pair of terminators utilized in the connector system.
Figure 8:
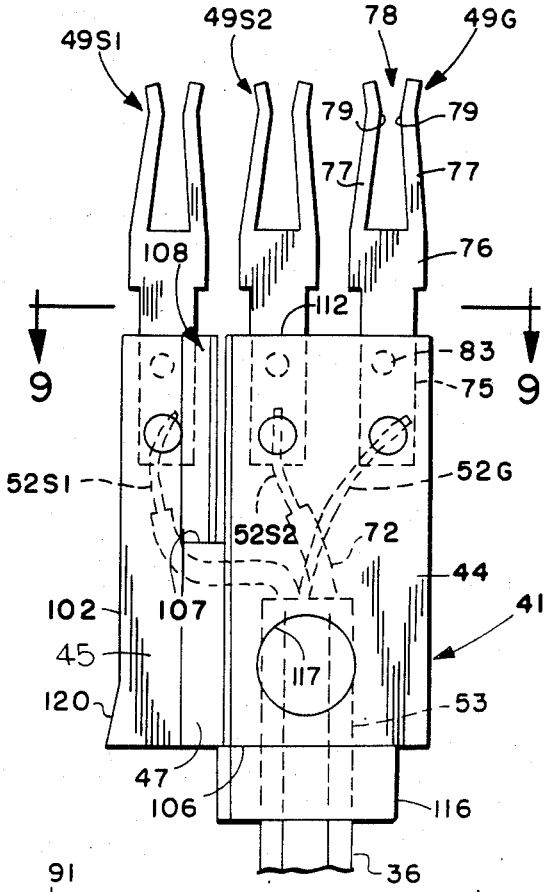
FIG. 8 is a side view of the terminator of FIG. 7 looking generally in the direction of the arrows 8—8 of FIG. 7.
Figure 9:
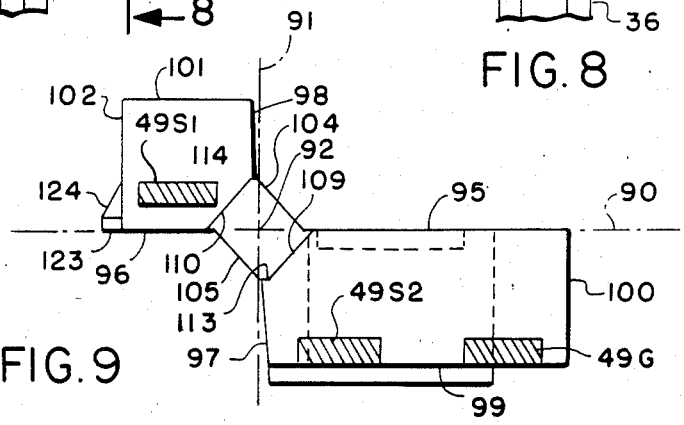
FIG. 9 is a transverse section through the terminator taken substantially along the line 9—9 of FIG. 8.

Turning now to FIGS. 7–9, the terminator 34 is shown in detail. The terminator 34 includes the aforementioned contacts 49, a portion of the cable 36, connections or junctions 70 (FIG. 7) of respective contacts and conductors 52 of the cable, and the body 41 of electrically insulating material which holds the contacts, conductors and cable in secure relatively fixed spacial relation. Preferably, the insulation material from which the body is formed is a plastic or plastic-type of material that is molded directly about and to at least a part of the cable, junctions and contacts in a manner that provides substantially hermetic encapsulation of the junctions, on the one hand, and secure strain relief retention of the cable in the body without applying strain to the junctions. The insulating material of the body also preferably is relatively rigid to facilitate manipulation of the terminator, for example to insert or to remove the same from the housing 31.

As previously indicated, the cable 36 is of twin-ax type having a pair or signal conductors 52S1 and 52S2 and a ground conductor or drain wire 52G. The signal conductors are each surrounded by separate insulation material 72 and the three conductors by a cable insulation sheath 53. It will be appreciated, though, that the invention may be used with other types of cables such as, for example, a cable of the shielded twisted pair type wherein twisted conductors are surrounded by an electrically conductive foil or mesh typically maintained at ground reference potential to provide a shielding function. With this latter type of cable, the conductive shielding material may be wound or wrapped upon itself to form essentially the equivalent of the conductor 52G of the illustrated twin-ax type cable for connection to the ground contact 49G at the respective junction 70.

The signal contacts 49S1 and 49S2 provide pin-out capability for the signal conductors 52S1 and 52S2, respectively, and the ground contact 49G for the ground conductor 52G. The contacts essentially are identical and each includes an anchor portion 75 coplanar with a base portion 76 from which a pair of tines 77 project generally longitudinally in line with the base and anchor portion. The tines however are bent at right angles out of the plane of the base and anchor portion and angle towards each other to define an insertion zone 78 for a respective pin contact. Preferably the tines have gold material at opposed contact areas 79 where the tines engage the respective pin contacts inserted between the tines in conventional manner.

Briefly referring to FIG. 1, it is noted that in the illustrated connector system 30 the contacts 49 are of the female type which are housed within the housing 31. However, if the contacts 49 were of the male type, such as pin contacts, then portions of such pins ordinarily would extend beyond the front wall 57 of a correspondingly modified housing for insertion into female contacts of a female connector system.

Each contact 49 also has a mold through hole 83 (FIG. 8) in the anchor portion 75 thereof through which insulating material of the terminator body 41 may flow during molding of the body to secure and lock the contacts in place. Tne anchor portion 75 may be offset as indicated at 84 (FIG. 7) or otherwise suitably angled for secure embedment in the respective contact anchor portion 44, 45 of the body 41. Each anchor portion also is attached, for example by soldering or welding, to the respective signal or ground conductor at a respective junction 70. As shown, the signal contact 49S2 and ground contact 49G are both anchored in substantially coplanar relationship in the contact anchor portion 44 and the other signal contact 49S1 in the other contact anchor portion 45 diagonally opposite the signal contact 48S2.

The contact anchor portions 44 and 45 of the terminator body 41 are generally rectangular and continuous over the linear extents thereof. That is, they are generally block-shape. As was indicated, such contact anchor portions are joined at one end of the terminator body by the diagonal web portion 47 and spaced at the other end of the body to receive the diagonal web portion of the other terminator body in the manner more fully discussed below. The diagonal web portion 47 maintains such contact anchor portions or blocks in diagonally offset relation as seen in FIG. 9. In the illustrated preferred embodiment, the contact anchor portions are located on opposite sides of parting planes 90 and 91 which insert at right angles along the center line 92 of the diagonal web portion.

Figure 12:
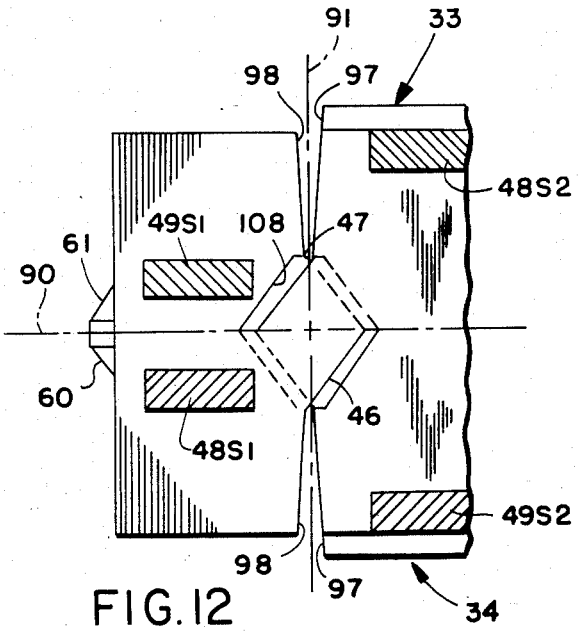
FIG. 12 is a transverse section similar to FIG. 9 but taken through the assembled pair of terminators.

As seen in FIG. 9, the contact anchor portions 44 and 45 have respective inner surfaces 95 and 96 coplanar with the parting plane 90 and other respective inner surfaces 97 and 98 at a small relief angle to the other parting plane 91. As for the outer surfaces 99 and 100 of the contact anchor portion 44 and the outer surfaces 101 and 102 of the contact anchor portion 45, such coincide with respective planar sides of an overall rectangular envelope of the assembled terminator pair as seen in FIG. 12.

In the terminator body 41, the diagonal web portion 47 is at the cable end of such body. The diagonal web portion has coplanar side surfaces 104 and 105 parallel to the longitudinal axis of the terminator body which in the illustrated embodiment form approximately a 45° angle with respective inner surfaces 95 and 96 of the contact anchor portions 44 and 45. The diagonal web portion extends from the cable end surface 106 of the terminator body to a point about midway along the length of such body, such diagonal web portion terminating at a transverse flat surface 107 defining one end of a slot 108 formed between diagonally opposed chamfered surfaces 109 and 110 of the connect anchor portions 44 and 45 at the contact end portion of the body.

The chamfered surfaces 109 and 110 are parallel and define the sides of the slot 108 which extends forwardly from the diagonal web portion 47 to the forward end face 112 of the terminator body 41 from which the anchored contacts 49 project. As seen in FIG. 9, there may be formed small shoulders 113 and 114 at the intersection of the chamfer surfaces 109 and 110 with the inner relieved surfaces 97 and 98, respectively. As seen in FIG. 12, the chamfer surfaces are spaced sufficiently to accommodate the width of the diagonal web portion 46 of the other terminator body 40.

In FIGS. 7 and 8, the contact anchor portion 44 can be seen to include a strain relief end block 116 intended to facilitate secure holding of the cable 36 to the terminator body 41 as well as to provide a strain relief function having relatively thicker dimensions than other portions of the body 41. The end block 116 and contact anchor portion 44 are molded directly to an end portion of the cable sheath 53 to form an integral structure therewith. The holes indicated at 117 are the result of mold bosses or pins used to hold the cable in proper position in the mold during molding of the terminator body about the cable end as well as the contacts 49 and those portions of the cable conductors 52 extending beyond the sheath 53.

The projecting signal conductor 52S2 and ground conductor 52G are both encased in the contact anchor portion 44 and connected at respective junctions 70 to the signal contacts 49S2 and ground contact 49G, respectively. A portion of the individual insulator 72 on the signal conductor 52S2 is of sufficient length to ensure against short circuiting contact with the usually uninsulated ground conductor 52G at their point of crossing. The other projecting signal conductor 52S1 initially extends substantially at right angles to the linear extent of the cable 36 to and through the diagonal web portion 47 for connection to the signal contact 49S1 at a respective junction 70 embedded in the contact anchor portion 45. The diagonal web portion is of sufficient width to accommodate the signal conductor and the individual insulation 72 thereon.

The anchoring hook 61 also can be seen in greater detail in FIGS. 7–9. The anchoring hook 61 is included on the contact anchor portion 45 at the rear or cable end thereof. Such anchoring hook has an anchor ramp surface 120 that slopes upwardly from the top outer surface 102 of such contact anchor portion terminating at a surface 122 coplanar with the rear or cable end face 106 of the terminator body 41. The anchoring hook also has an inner surface 123 flush with the inner surface 96 of such contact anchoring portion 45 and an opposite sloped surface 124.

When the terminator 34 is inserted into the housing 31, it is intended that the ramp surface 120 will cause resilient deflection of the locking tab 62. When the anchoring hook moves past the locking tab and into the opening 64 in the housing, the locking tab deflects or snaps back to engage the rear edge 122 of the anchoring hook to effectively lock the terminator in the housing. When received in the housing opening, the anchoring hook occupies one side of such opening to permit like receipt of the anchoring hook 60 of the other terminator 33 at the other side of the opening.

Figure 11:
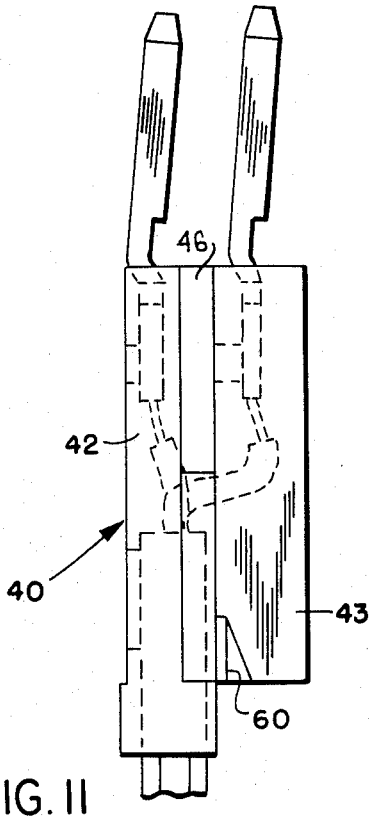
FIG. 11 is a top view of the terminator of FIG. 10 looking generally in the direction of the arrows 11—11 of FIG. 10.
Figure 10:
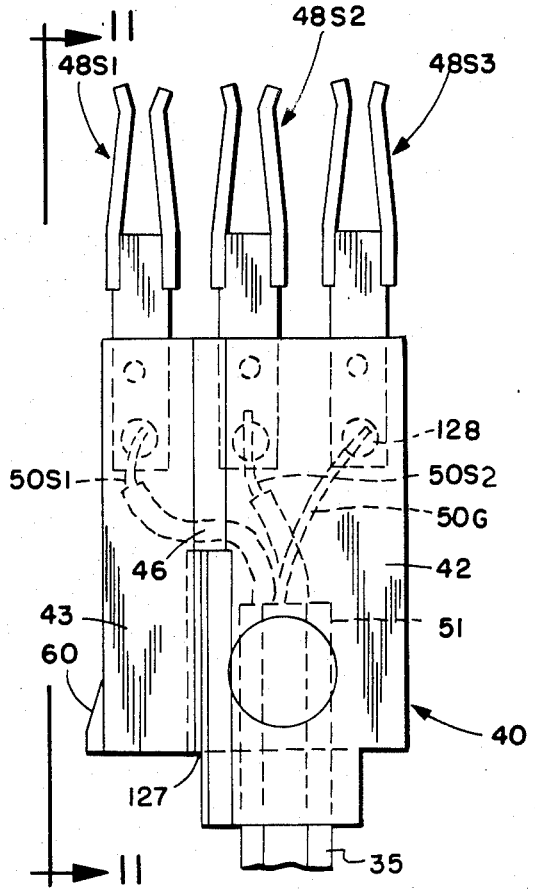
FIG. 10 is a side view of the other terminator utilized in the connector system.

With reference to FIGS. 10 and 11, the terminator 33 is similar to the terminator 34. However, the contact anchor portions 42 and 43 of the terminator 33 are diagonally opposed in reverse manner to those of the terminator 34 as best seen in FIG. 12. Also, the diagonal web portion 46 is at the forward or contact end of the terminator body 40 while the slot thereof, indicated at 127, is at the rear or cable end. This is opposite to the arrangement of such features in the body 41 of the other terminator 34. Other than these differences, the terminators are essentially identical but reversely oriented in relation to the parting plane 90 as seen in FIG. 12.

Similar to the terminator 34, the terminator 33 includes a portion of the cable 35 and the signal conductors 50S1 and 50S2 of such cable are connected to respective signal contacts 48S1 and 48S2 at respective junctions 128. Also, the signal conductor 50S1 passes through the diagonal web portion 46 for connection to the respective signal contact 48S1.

In FIG. 12, the terminators 33 and 34 are shown nested or interengaged according to the invention. The diagonal web portion 46, 47 of each terminator body 40, 41 is received in the slot 108, 127 in the other terminator body. When thusly nested, the terminator bodies are contiguous and coextensive and together form a rectangular block shape, each contact anchor portion of each terminator body occupying a respective quadrant of the termination pair. In the illustrated embodiment, the quadrants are defined by the intersecting parting planes 90 and 91.

As shown, the diagonal web portions 46 and 47 are slightly undersize in relation to the width of slots 108 and 127 in which they respectively are received to allow for some adjusting movement that may be needed because of tolerance variations during molding of the terminator bodies 40 and 41. Such movement also is provided for by the relieved inner surfaces 97, 98 of the respective contact anchor portions. The terminators however preferably mate in flush contact along the parting plane 90.

As also seen in FIG. 12, the anchoring hooks 60 and 61 align in juxtaposed side-by-side relationship cooperatively to act upon the locking tab 62 (FIGS. 1, 2 and 6) when the terminators 33 and 34 are first paired and then inserted into the housing 31. It is noted, however, that the terminator 33 may first be inserted into the housing and then the other terminator 34. Also, the anchoring hook 60 on the terminator 33 could be eliminated and the terminator 33 still held in the housing by end-to-end abutment of the diagonal web portions 46 and 47 of the terminators.

Turning now to FIGS. 13–16, details of the housing 31 are illustrated. The housing 31 has top wall 63, side walls 130, bottom wall 131 and front wall 57. Interiorly, the walls define a cavity or cell 132 of a size adequate to closely receive the entire transverse cross section of the terminator pair 32 except for the relief blocks 116 which reside to the rear of the housing with overlap upon the rear edges of the side walls 130. At the forward portion of the housing, transverse and longitudinal divider walls 133 and 134 partition and separate six sub-cell portions 135 of the housing cavity 132. The sub-cell portions 135 receive respective contacts of the terminator pair while providing physical and electrical isolation between such contacts to avoid short circuits.

The divider walls 133 and 134 extend rearwardly from the front wall 57 and have coplanar rear abutment surfaces 138 which limit maximum insertion of the terminators 33 and 34, such rear abutment surfaces acting as stops to the front end faces 112 of the terminators. The maximum extension corresponds to the extension required to engage the anchoring hooks 60 and 61 of the terminators in the opening 64 in the top wall 63 of the housing.

The divider walls 133 and 134 effect a measure of confinement for the contacts to avoid physical displacement, distortion or the like in response to the force of a pin contact inserted to engagement therewith via respective access holes 56 in the front wall 57 of the housing. The access holes are tapered in the manner illustrated to help guide such pin contacts into respective sub-cell portions 135.

Figure 13:
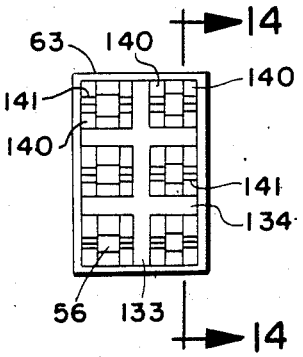
FIG. 13 is a back view of the housing utilized in the electrical connector system.

Properly to position the terminator contacts for aligned receipt of respective pin contacts, the walls 133 and 134 defining each sub-cell portion 135 have sloped surfaces or flats 140 which center the tines of the contacts to the access holes 56. The sloped flats are located at the four corners and base of the sub-cell portions outwardly adjacent the respective access opening with the guide surfaces sloping away from such access opening as seen in FIG. 15. The flats are transversely paired (in relation to the housing and horizontally as seen in FIG. 13), and the flats of each pair are longitudinally separated (vertically in FIG. 13) from a respective flat of the other pair by a respective rib 141 projecting transversely into the sub-cell portion at the longitudinal center thereof. The flats of each pair at the respective side of the ribs 141 define a tapered guide channel for a respective tine of a contact, the flats engaging and transversely centering the tine to the access hole. The flats of each pair also are transversely spaced apart slightly more than the width of a tine across its contacting surface to allow longitudinal separation of the tines (in relation to the housing cross-section) upon insertion of a pin contact therebetween. The ribs 141 project transversely inwardly from respective walls of the sub-cell portions and terminate generally in line with but slightly inwardly of respective transverse sides of the access opening. The ribs have tapered rear edges (to the right in FIG. 14) and serve longitudinally to separate the tines to position the tines at opposite sides thereof between the sloped flats of respective pairs of such flats. Accordingly, misaligned tines or tines which are too close together are guided into and held in proper alignment with the access opening as the terminator is inserted into the housing from the rear thereof.

Figure 14:
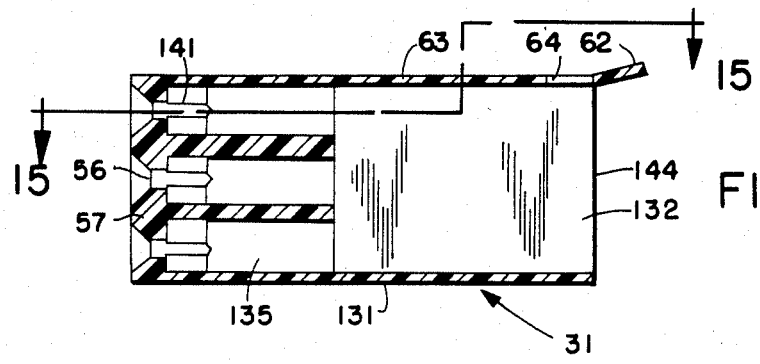
FIG. 14 is a longitudinal section through the housing of FIG. 13 taken substantially along the line 14—14 of FIG. 13.
Figure 15:
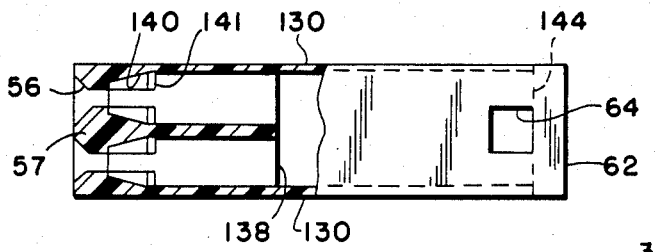
FIG. 15 is a part longitudinal section, part top view of the housing taken substantially along the line 15—15 of FIG. 14.
Figure 19:
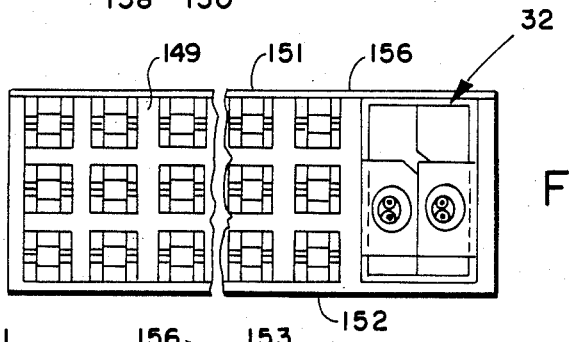
FIG. 19 is a fragmentary back view of the electrical connector system looking generally in the direction of the arrows 19—19 of FIG. 18.
Figure 17:
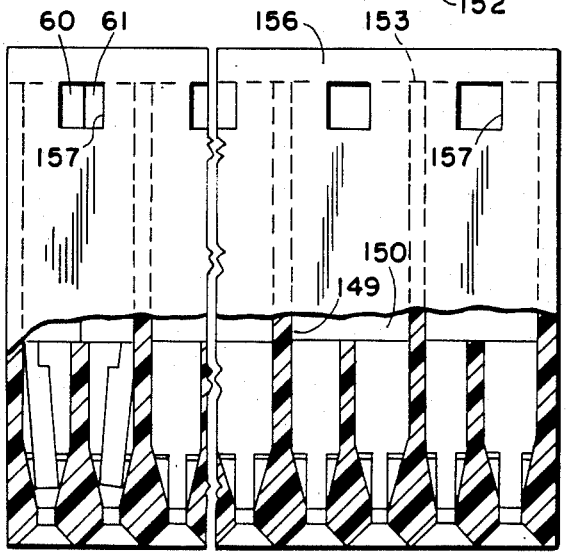
FIG. 17 is a fragmentary top view, partly broken away in section, of the electrical connector system of FIG. 16 looking generally in the direction of the arrows 17—17 of FIG. 16.
Figure 16:
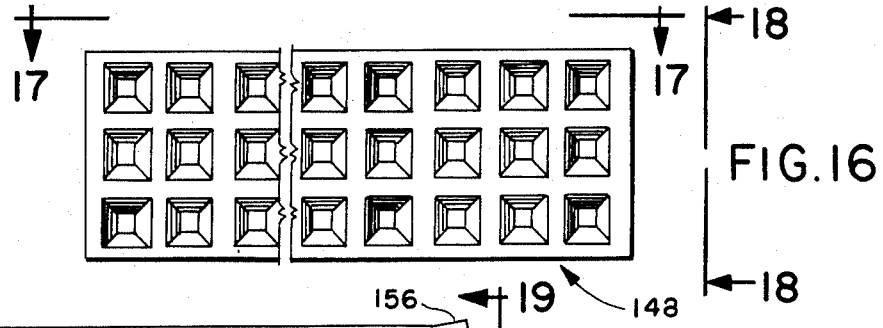
FIG. 16 is a fragmentary front view of another form of electrical connector system according to the invention.
Figure 18:
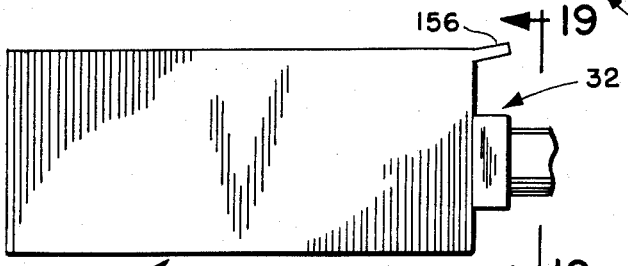
FIG. 18 is a side view of the electrical connector system looking generally in the direction of the arrows 18—18 of FIG. 16.
Figure 21:
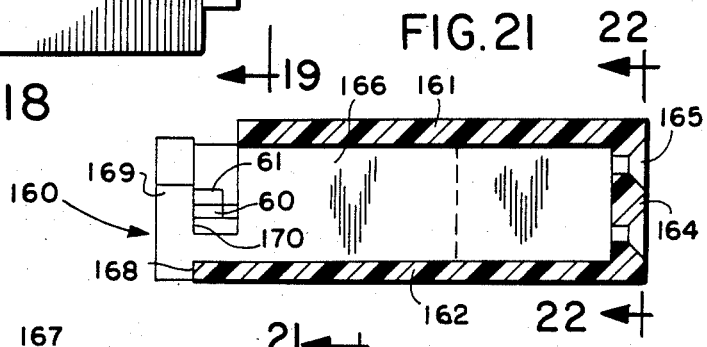
FIG. 21 is a section through the electrical connector system of FIG. 20 taken substantially along the line 21—21 of FIG. 20.
Figure 20:
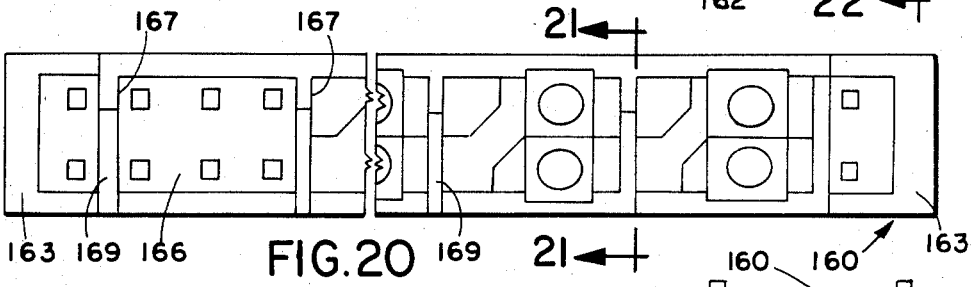
FIG. 20 is a back view of a further form of electrical connector system according to the invention.
Figure 22:
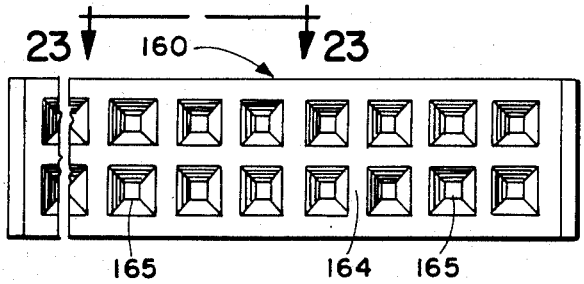
FIG. 22 is a front view of the electrical connector system of FIG. 20 looking generally in the direction of the arrows 22—22 of FIG. 21.
Figure 23:
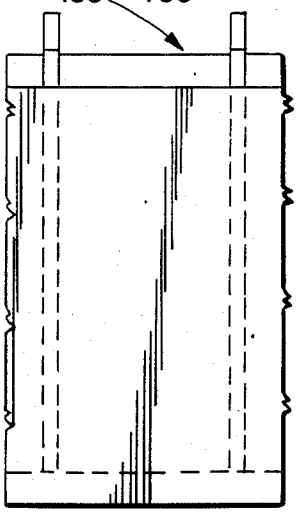
FIG. 23 is a fragmentary top view of the electrical connector system of FIG. 20 looking generally in the direction of the arrows 23—23 of FIG. 22.

The locking tab 62 formed as an extension of the top wall 64 of the housing 31 also can be seen in FIGS. 14 and 15 to extend rearwardly beyond the rear end plane 144 of the side and bottom walls 130 and 131 of the housing. The rear edge of the opening 64 in the housing top wall defining the locking tab is coplanar with such rear end plane 144. The housing desirably is made of nylon plastic material or other suitable material with at least the top wall at the locking tab being relatively thin a facilitate resilient flexure of the locking tab out of the plane of the top wall to permit insertion and released removal of the terminators.

Again referring to FIGS. 1 and 2, it should now be apparent that the contacts in each row of the illustrated dual row connector pin-out configuration of the termination has the pattern of a signal contact of one terminator followed by a signal contact and then the ground contact of the other terminator. This is a preferred arrangement although modification may be easily made by connecting the conductors of each cable to different respective contacts of the respective terminator. For example, the signal contacts of the same terminator may be further isolated from each other by connecting the ground conductor to the intermediate contact of the terminator whereupon the pattern in each row would be a signal conductor of one terminator followed by the ground conductor and then a signal conductor of the other terminator.

The aforedescribed terminator pair 32 may be utilized with a single cell or cavity housing as illustrated in FIGS. 1 and 2 as well as one basic building block in a multi-cell housing. FIGS. 16–19 illustrate one type of multi-cell housing 148 (denoted a $3 \times n$ housing) wherein terminator pairs 32 inserted into the housing are arranged in side-by-side relation to give a multi-connector pin-out configuration having an odd number of rows, three as shown. In such housing, the terminator pairs arranged in transverse side-by-side relation are spaced apart by partition walls 149 forming with outer walls of the housing respective cells 150 each sized to accommodate a terminator pair. Each cell 150 is comprised of a rear portion accommodating the molded terminator bodies of each terminator pair and a sub-cell portion for receiving respective contacts of the terminator pair. Each partition wall 149 extends between top and bottom walls 151 and 152 of the housing.

The top wall 151 projects rearwardly beyond the rear end plane 153 of the top, side and partion walls to form a locking tab 156. The top wall also has a row of apertures 157 respectively associated with the cells 150 for receipt of the anchoring ramps 60, 61 of respective terminator pairs. The locking tab 156 may be continuous but sufficiently flexible in relation to adjacent portions of the locking tab to permit individual insertion and release of the terminator pairs into and out of respective cells of the housing. If desired, the locking tab may be divided into a plurality of individual tabs by slitting the same generally in line with the partition walls dividing the housing into cells.

As will be appreciated, the ground conductors of terminators inserted into the housing 148 may all reside in one row of the three-row multi-connector pin-out configuration. On the other hand, the signal contacts of each terminator will be disposed in diagonal relation in respective ones of the other two rows of the pin-out configuration.

As seen in FIGS. 20–23, plural terminator pairs 32 may be inserted into respective cells of a common housing 160 with their longer widths in alignment. The illustrated housing 160, denoted a $2 \times n$ housing, has top, bottom and side walls 161, 162 and 163, and a front wall 164 including access holes 165 in a dual row configuration. The cells 166 of the housing are defined by partition walls 167 extending between the top and bottom walls 161 and 162. In this embodiment, the partition walls 167 project rearwardly beyond the rear end plane 168 of the top, side and bottom walls to form respective locking tabs 169. The partition walls also are provided with openings 170 inwardly adjacent the locking tabs 169, such openings being intended to receive the anchoring hooks 60, 61 of respective terminator pairs 32.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the following claims.

STATEMENT OF INDUSTRIAL APPLICATION

In view of the foregoing it will be appreciated that the present invention may be used to effect multiple electrical connections in a highly efficient manner while maintaining accuracy of high speed signal transmission and discrete wire capability together with convenient servicing.

We claim:

1. In combination, a pair of cables or conductor sets each including at least two conductors, and a terminator pair for terminating said conductors of respective ones of said cables or conductor sets, each terminator comprising a body of insulating material having a pair of contact anchor portions joined by a diagonal web portion at one axial end of the body and diagonally spaced at the other axial end of the body to receive the diagonal web portion of the other terminator for mating interengagement of the terminators, and at least one contact anchored in each contact anchor portion and electrically connected to a respective conductor of the corresponding cable or conductor set; and at least one of said cables or conductor sets being anchored in one contact anchor portion of the corresponding terminator body, and having one conductor thereof electrically connected to a contact anchored in said one contact anchor portion and another conductor thereof passing through the web portion of the corresponding terminator body for electrical connection to a contact anchored in the other contact anchor portion of the terminator body.

2. A combination as set forth in claim 1, wherein said terminator pair is substantially rectangular in transverse cross-section, and each contact anchor portion is substantially rectangular in transverse section and occupies a respective quadrant of the terminator pair.

3. A combination as set forth in claim 1, wherein a contact in each contact anchor portion is located at a respective corner of a rectangle defined by such contacts, and such contacts of each terminator are at respective diagonally opposed corners of such rectangle.

4. A combination as set forth in claim 1, wherein each contact has coupling means for coupling the contact to another device and connecting means for electrically connecting the contact to a respective conductor at a junction, and each terminator body is molded directly to said coupling means, junction and a portion of the conductor.

5. A terminator pair as set forth in claim 1, wherein adjacent contacts respectively anchored in the contact anchor portions of each terminator are spaced apart a distance greater than the spacing between such contacts and the corresponding contacts of the other terminator.

6. A combination as set forth in claim 1, wherein each contact includes connecting means for electrically connecting the contact to a respective conductor and coupling means for electrically coupling the contact to another device.

7. A combination as set forth in claim 6, wherein said connecting means of each contact is anchored in the respective contact anchor portion of the respective terminator body.

8. A combination as set forth in claim 1, wherein each cable or conductor set includes a pair of signal carrying conductors, and further comprising electrical junctions between said signal conductors of each cable or conductor set and respective contacts of the corresponding terminator.

9. A combination as set forth in claim 8, wherein said junctions are encapsulated by the corresponding terminator body.

10. A combination as set forth in claim 8, wherein said at least one of said cables or conductor sets includes a ground conductor electrically connected to a second contact anchored in said one contact anchor portion generally in coplanar relation with the other contact anchored in said one contact anchor portion.

11. A combination as set forth in claim 1, wherein said contact anchor portions of each terminator body are generally block-shape and have planar inside faces which abut corresponding faces of the other terminator body along a center parting plane through the terminator pair.

12. A combination as set forth in claim 11, wherein said contact anchor portions of each terminator have other inside planar faces opposed to such other inside faces of the other terminator, such other inside faces being at a slight relief angle to another parting plane perpendicular to the center parting plane to provide for limiting adjustment of the terminator bodies in relation to each other.

13. A combination as set forth in claim 11, wherein said contact anchor portions of each terminator body have outer planer faces forming continuations of respective outer planar faces of the other terminator body.

14. A cable termination comprising a housing having walls defining at least one cell for receiving a cable terminator, said terminator including locking means for locking said terminator in such cell, and a wall of said housing having at one end thereof resilient tab means cooperable with said locking means to hold said terminator in said housing, said tab means being selectively deflectable to permit insertion and removal of said terminator.

15. A termination as set forth in claim 14, further comprising abutment means in said housing engageable with leading end faces of said terminators to limit the extent of terminator insertion into said housing.

16. A termination as set forth in claim 14, wherein said abutment means includes interior walls at one end of said housing which divide the cell into sub-cells sized to receive respective contacts anchored in said terminator.

17. A termination as set forth in claim 14, wherein said resilient tab means is formed by a continuation of one wall of said housing.

18. A termination as set forth in claim 17, wherein said one wall has relief means adjacent said resilient tab means for receipt of said locking means when said terminator is in locked condition.

19. A termination as set forth in claim 18, wherein said terminator includes a body of insulating material having a locking ramp thereon forming said locking means, said locking ramp being operable cammingly to deflect said resilient tab means to permit insertion of said terminator into said housing.

20. A termination as set forth in claim 14, wherein said housing includes a row of cells for receipt of respective terminators, each cell being separated from an adjacent cell by an intermediate wall.

21. A termination as set forth in claim 20, wherein said one wall of said housing is an outer wall spanning and forming one side of such row of cells.

22. A termination as set forth in claim 20, wherein said one wall is an intermediate wall of said housing.

23. A termination as set forth in claim 14, including two terminators forming a terminator pair receivable in one cell of the housing, said terminator pair including a protrusion engageable by said resilient tab means for holding said terminator pair in said housing.

24. A termination as set forth in claim 23, wherein said protrusion includes a portion thereof on each terminator of said terminator pair which portions are cooperative to form said protrusion when correctly aligned.

25. A termination as set forth in claim 24, wherein said one cell has relief means adjacent said resilient tab means for receipt of such portions.

26. A termination as set forth in claim 24, wherein each such portion of said protrusion has an inclined ramp surface operative to deflect said resilient tab means during insertion of said terminator pair.

27. A cable termination comprising a housing having at least one cell of generally rectangular cross-section, and a pair of diagonally nested terminators for respective cables received in said cell, each terminating at diagonally opposed contacts therein the conductors of a respective cable.

28. A termination as set forth in claim 27, wherein the contacts of said terminators are arranged in two rows at an interval spacing of x with two contacts on each terminator located in respective rows in diagonal opposition at a spacing of about.

29. A termination as set forth in claim 27, wherein two contacts in each terminator are arranged along a diagonal line intersecting the diagonal line of the two contacts in the other terminator.

30. A termination as set forth in claim 29, wherein each terminator includes a body of insulating material having a pair of contact anchor portions joined by a diagonal web portion at one end of said body and diagonally spaced at the other end of said body to receive the diagonal web portion of the other terminator for mating interengagement of the terminators, and at least one contact anchored in each contact anchor portion for connecting a respective conductor of the corresponding cable to another member.

31. A termination as set forth in claim 27, wherein the cable includes a pair of conductors for carrying high speed signals and at least one reference conductor for maintaining a reference potential relative to such signals, and each terminator includes a contact for terminating a respective conductor of the corresponding cable.

32. A termination as set forth in claim 31, wherein each terminator includes an electrically insulating body molded directly to at least a part of each contact and conductors and about the junctions of respective contacts and conductors.

33. A termination as set forth in claim 27, including lock means for releasably retaining said terminators in said cell.

34. A termination as set forth in claim 33, wherein said lock means includes an anchoring detent on at least one of said terminators and impediment means in said housing operable to engage said detent to hold said terminators in said housing.

35. A termination as set forth in claim 34, wherein said impediment means includes a flexible tab portion of said housing deflectable to enable insertion, locking and removal of said terminators.

36. A cable termination comprising a housing having at least one cell therein for receipt of a cable terminator, said terminator including an electrically non-conductive body and at least one contact anchored in said body, said contact including electrical coupling means projecting from said body for coupling the contact to another device, and said housing having wall means closing one end of said cell, access means in said wall means for providing access of another device into said cell to electrical engagement with said coupling means, and sloped wall means at the interior of said cell adjacent said access means for guiding and centering said coupling means to said access means.

37. A termination as set forth in claim 36, wherein said coupling means includes a pair of fork contact tines, and said sloped wall means includes a pair of oppositely sloped surfaces for each tine.

38. A termination as set forth in claim 37, wherein the sloped surfaces of each pair thereof are separated by a divider from respective sloped surfaces of the other pairs, said divider being operative to space the tines apart.

39. A terminator pair for terminating conductors of respective cables or conductor sets, in combination with a housing therefor; each terminator comprising a body of insulating material having a pair of contact anchor portions joined by a diagonal web portion at one end of the body and diagonally spaced at the other end of the body to receive the diagonal web portion of the other terminator for mating interengagement of the terminators, and at least one contact anchored in each contact anchor portion for connecting a respective conductor of the corresponding cable or conductor set to another member, said terminator pair being substantially rectangular in transverse cross-section, and each contact anchor portion being substantially rectangular in transverse cross-section and occupying a respective quadrant of the terminator pair; and said housing having at least one cell for receipt of said terminator pair, said housing and terminator pair including respective means cooperable to retain said terminator pair in said cell.

40. A combination as set forth in claim 39, wherein said means to retain includes locking ramps on said terminators and a locking tab on said housing cooperable with said locking ramps to hold said terminators in said cell.

41. A combination as set forth in claim 40, wherein said locking tab is deflectable to clear said locking ramps for insertion and removal of said terminators.

* * * * *

UNITED STATES PATENT OFFICE

CERTIFICATE OF CORRECTION

Patent No. 4,626,054 Dated December 2, 1986

Inventor(s) John N. Tengler et al

It is certified that error appears in the above-identified patent and that said Letters Patent are hereby corrected as shown below:

In claim 28, line 5, after "about" insert

--x/Sin (45°)--.

Signed and Sealed this

Twelfth Day of January, 1988

*Attest:*

DONALD J. QUIGG

*Attesting Officer*

*Commissioner of Patents and Trademarks*